United States Patent [19]

Nestegard

[11] 4,451,033

[45] May 29, 1984

[54] UPPER BODY EXERCISER FOR A STATIONARY BICYCLE AND A BICYCLE INCLUDING THE SAME

[76] Inventor: Sander C. Nestegard, 3458 Glen Oakes, White Bear Lake, Minn. 55110

[21] Appl. No.: 308,572

[22] Filed: Oct. 5, 1981

[51] Int. Cl.[3] ..... A63B 23/02; A63B 23/04

[52] U.S. Cl. ..... 272/73; 272/117; 272/DIG. 4

[58] Field of Search ..... 272/73, 117, 70, 72, 272/DIG. 4, 97, 70.1, 67, 68, 70.2, 118, 143, 116; 128/25 R; 273/84, 26 B, 186 A, 81.2

[56] References Cited

U.S. PATENT DOCUMENTS

| | | | |
|---|---|---|---|
| 1,676,270 | 7/1928 | Mattison | 273/186 A |
| 2,261,355 | 11/1941 | Flynn | 128/25 R |
| 2,356,260 | 8/1944 | Maxwell | 272/136 |
| 3,392,976 | 7/1968 | Hayes | 272/124 X |
| 3,539,185 | 11/1970 | Andis | 273/81.2 |
| 3,664,027 | 5/1972 | Fritz | 272/73 X |
| 3,690,655 | 9/1972 | Chapman | 272/67 X |

FOREIGN PATENT DOCUMENTS

| | | | |
|---|---|---|---|
| 2826994 | 1/1980 | Fed. Rep. of Germany | 272/73 |

OTHER PUBLICATIONS

New Total Jogger, The New York Times, Sunday, Sep. 7, 1969, Shopping Guide, p. 29S.

*Primary Examiner*—Robert A. Hafer
*Assistant Examiner*—Arnold W. Kramer
*Attorney, Agent, or Firm*—John C. Barnes

[57] ABSTRACT

Weighted bars may be pivotally connected at one end outward of the pedals on a stationary bicycle exerciser and provided with hand grips at the opposite end to permit the exercise of the upper body as well as exercise of the lower body on the bicycle.

2 Claims, 5 Drawing Figures

UPPER BODY EXERCISER FOR A STATIONARY BICYCLE AND A BICYCLE INCLUDING THE SAME

DESCRIPTION

Field of the Invention

This invention relates to an improvement in exercisers and more particularly to an improvement in the stationary bicycle exercisers such that the upper body may be readily exercised to the rider's enjoyment while exercising the lower portion of his body.

Background Art

Exercise has become a more important part of people's programs in their daily lives to maintain a degree of fitness and flexibility which makes life more comfortable and satisfying. The stationary bicycle exercisers have become popular for the casual workout or for a vigorous exercise program. The quality of the exercise and the time spent on the exercise program may be reduced by exercising the total body simultaneously. To accomplish this using the stationary bicycle it is desirable to have some means of exercising the upper body. To do this, there have been provided handles connected through ropes and pulleys to weights, handle bars on the stationary bicycle which are movable back and forth against a resistance loading, or handle bars pivotable independently about the axis of the wheel to move the arms forward and backward while in a seated position on the bicycle.

These devices have not permitted the person already owning a bicycle-type exerciser to add the exerciser for the upper body to his existing bicycle or to provide a bicycle exerciser with an upper body exercising device which may be driven with the operation of the peddle to maintain the motion of the upper body during the exercising of the lower body.

The present invention provides arms which are capable of being mounted on existing bicycle exercisers to add the convenience of exercising the upper body along with the bicycling afforded by the bicycle. Further, the present invention provides an attachment to a stationary bicycle exerciser which will permit adjustment of the amount of exercise afforded to the upper body.

The present invention will also provide an exercise for the upper body which will provide for coordination and a variety of motion as desired during the operation of the bicycle exerciser.

Disclosure of Invention

The present invention is directed to a pair of arms which may be pivotally mounted on the outer side of the pedals extending from the crank arms of the bicycle sprocket and which arms are provided with a handle at the upper end. The arms are weighted. Preferably, the position of the weight for the arms may be adjusted to increase or decrease the moment arm for the weight about its pivot point. The weighted arms provide exercise for the upper body in that the pushing and pulling of the upper ends of the arms require the acceleration and deceleration of the weighted arms in opposite directions during the exercise program. The amount of energy needed to accelerate and decelerate the arms throughout the extent of the arm is determined by the position of the weight or the amount of weight carried by the arm. The arms also add to the energy necessary to rotate the sprocket.

The arms are pivotally mounted to a pedals shaft which extends entirely through a foot pedals and has on the opposite end suitable threads for coupling to the free end of the radial crank arms of the sprocket. Preferably the weights are adjustable within a hollow rod affording an aesthetic appearance and adjustability within the rod which is easy and convenient for the operator.

Brief Description of Drawing

The present invention will be more fully described hereinafter with reference to the accompanying drawing wherein.

Best Mode For Carrying Out The Invention

The present invention is directed to a stationary bicycle exerciser having a pair of weighted rods or arms pivotally connected at one end to the shaft of the foot pedals and having a handle at the upper end to be grasped by the operator.

Figure 1:
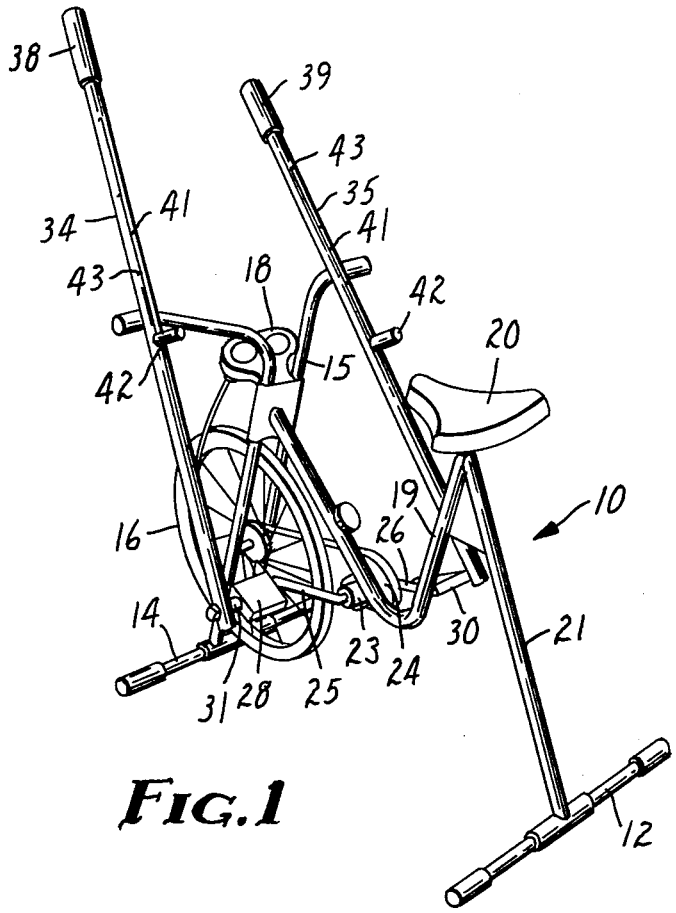
FIG. 1 is a perspective view of a stationary bicycle exerciser incorporating the present invention.
Figure 2:
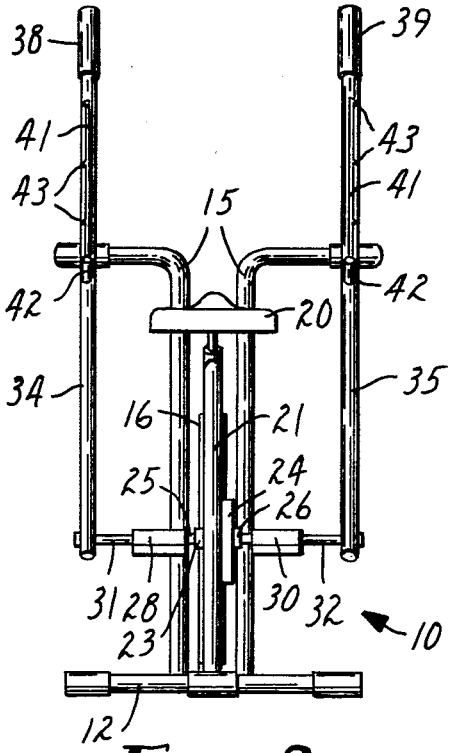
FIG. 2 is a rear elevational view of a stationary bicycle exerciser incorporating the present invention.

As illustrated in FIG. 1, a stationary bicycle exerciser generally designated 10 comprises a frame including two parallel spaced feet or brace bars 12 and 14, a fork 15 extending upperwardly from the foot 14, means on the fork for supporting the driven wheel 16, a panel 18 supporting the instruments to determine the speed of the wheel or the amount of resistance afforded by the brake means (not shown) for the driven wheel, a brace member extending from the fork 15 to support the sprocket wheel and seat 20 and a brace member 21 connected to the brace member 19 to support the seat from the rear support 12.

The brace member 19 supports a bearing hub 23 for supporting or journalling the axis of a sprocket 24 from which extends two radial crank arms 25 and 26. To the free ends of the crank arms 25 and 26 are horizontally extending shafts which are generally fixed thereto and which support pedals 28 and 30. These shafts, identified by the reference numerals 31 and 32, extend through the peddles 28 and 30 and provide suitable journals for the peddles such that the peddles are free to rotate on the shafts. The extended ends of the shafts 31 and 32 are then pivotally connected, respectively, to one end of a pair of weighted arms 34 and 35. The shafts have an extended length beyond the edge of the peddles such that the ends of the arms will be spaced outward from the sprocket a substantial distance past the pedals to avoid interference with the operator's leg.

The weighted arms 34 and 35, as mentioned, are provided with means to pivotally mount said arms the shafts 31 and 32 at one end and are provided with grips or hand grips 38 and 39 at the opposite end which may be grasped by the operator during the exercise program. The weighted arms are movable to and fro about their pivotal connection to the shafts 31 and 32. Also, the lower ends of the arms 34 and 35 are rotated under the influence of the operator's feet on the pedals 28 and 30. A bending and straightening of the arms force the arms 34 and 35 toward and away from the body exercising the arm muscles. The rotational movement of the lower end of the arms 34 and 35 causes the hand grips 38 and 39 to move up and down as they are driven by the sprocket. This causes a similar upward and downward movement of the arms and rotation of the upper arm at the shoulder to increase the flexibility of the shoulder as the strength of the upper arm is increased by moving the arms 34 and 35 toward and away from the body against the forces necessary to cause the arms 34 and 35 to accelerate and decelerate with the desired moment arm afforded by the position of and weight on each arm 34 and 35.

Figure 3:
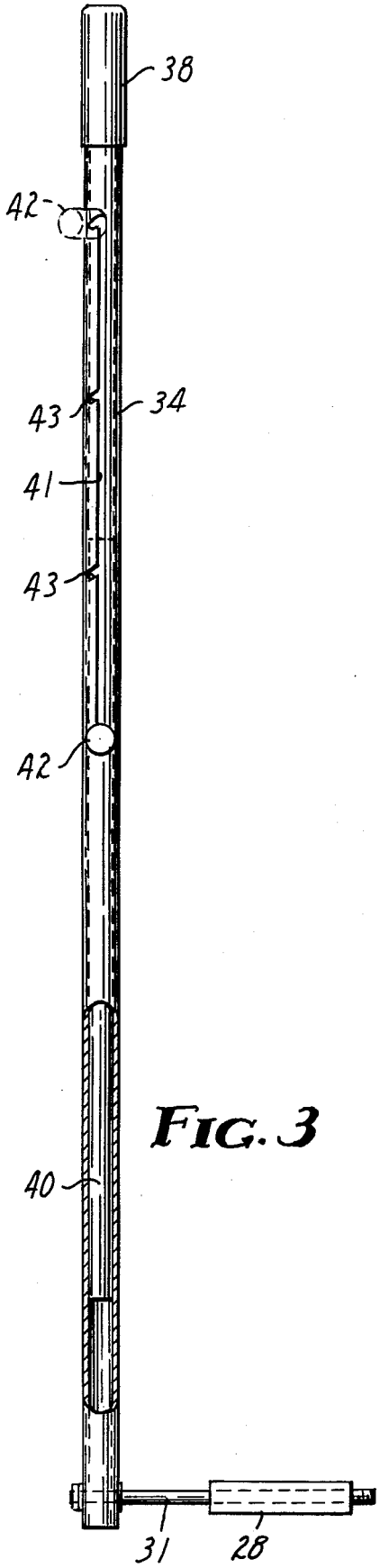
FIG. 3 is a plan view of an arm of the present invention having portions thereof broken away to illustrate interior members.

Each arm 34 and 35 is similarly constructed but preferably one for the right hand and one for the left hand. An arm preferably comprises a forty-four inch straight elongate tube of extruded aluminum having an outside diamter of one inch and a wall thickness of 0.055 inch. Disposed within the hollow tube is a solid rod 40 of steel which weighs approximately 5 pounds and has an outside diameter of $\frac{7}{8}$ inch, and wich is 24 inches long. The rod 40 is disposed within the hollow tube in such a manner that it is movable within the tube from a position with one end adjacent the journal for the arm to a position where one end is adjacent the opposite end of the tube near the hand grip. The tube is provided with an elongate slot 41 in one side through which extends a handle 42 fixed to the rod 40. The handle 42 may be moved up and down within the slot to change the position of the weight within the tube. As illustrated in FIG. 3, the slot 41 is provided with transversely and angularly disposed communicating slots 43 which define the positions in which the weight may be fixed to change the moment arm of the weight about the pivot shaft. This change in moment arm changes the amount of force necessary to pivot the arm about its pivot point and changes the amount of exercise afforded to the operator.

The arm is provided at its lower end with a sleeve of nylon or bearing material which journals the tube on the outboard end of the shaft 31, thus permitting smooth pivotal movement with respect to the shaft 31. The shaft extends approximately 3 inches beyond the edge of the foot pedals 28 which is approximately 4-$\frac{1}{2}$ inches in width and which is freely journalled on the shaft 31. The opposite end of the shaft is provided with a suitable washer and is threaded to be received by the threaded end of the crank arm of the bicycle sprocket.

Figure 4:
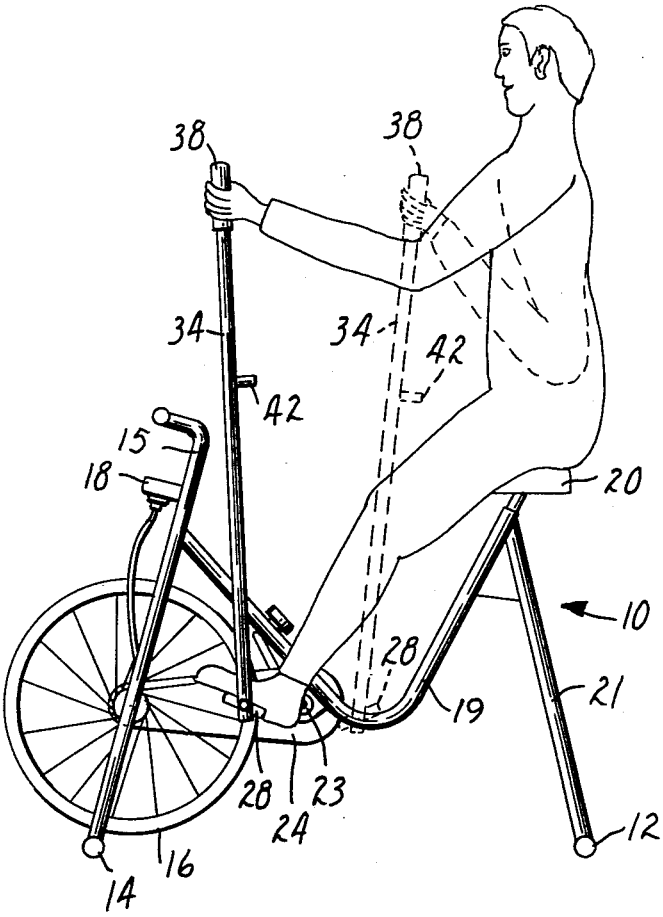
FIG. 4 is a schematic diagram of a person operating the stationary exerciser.

Referring now to FIG. 4 you will note an operator on the bicycle, and for matters of simplicity, only one side of the operator is shown with his arm extended in solid line position moving the arm 34 in a direction away from him to extend the arm as the pedals is rotated, and showing that he has moved the arm back toward the body in the dotted line position as the pedals has moved from the solid line to the dotted line position. Continued movement of the arm to and fro during the bicycling provides a lot of movement for the arms and exercise for the shoulder muscles as well.

Figure 5:
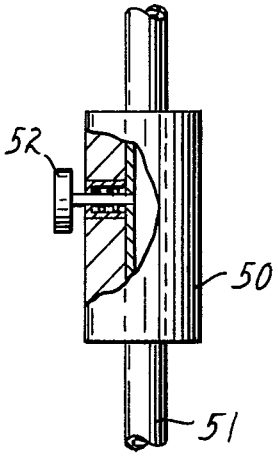
FIG. 5 is a detail view of a second embodiment of the present invention.

The arms 34 and 35 could be solid to give them a desired weight and FIG. 5 shows a further embodiment wherein the adjustable weight 50 is supported on the outside of a rod 51. The position of the weight is adjusted by movement of a pin 52 in and out of a plurality of openings spaced along the length of the rod forming the arm.

Having thus described the present invention with respect to the preferred embodiment and other embodiments, it will be understood that other changes may be made with respect to the invention without departing from the spirit and scope of the invention as defined by the appended claims.

I claim:

1. A weighted arm for attachment to a stationary bicycle exerciser comprising an elongate hollow tube having means at one end for pivotal connection to an extended bicycle pedal shaft and having a hand grip at the opposite end, a weight supported within said hollow tube, said weight comprises a cylindrical rod supported within said hollow tube, and a handle connected to the cylindrical rod for movement of the cylindrical rod along the length of the tube, said tube having a longitudinal slot receiving said handle and at least one angularly positioned slot communicating with said longitudinal slot for receiving said handle to retain the same in adjusted positions.

2. In a stationary bicycle exerciser having a frame, a seat supported on the frame, a sprocket from which radial arms extend, means for resisting rotation of said sprocket, the improvement comprising shafts extending perpendicular from the radial arms, pedals rotatably mounted on said shafts adjacent said radial arms, weighted arms pivotally connected at one end on said shafts and having a handle adjacent the opposite end, said weighted arms each comprising an elongate hollow tube having a longitudinal slot herein and at least one angularly positioned slot communicating with said longitudinal slot, a cylindrical rod supported in each said hollow tube, and a handle connected to said cylindrical rod and extending through said longitudinal slot for movement of said cylindrical rod closer to or farther from said one end and engageable with said at least one positioned slot to retain said rod in an alternate position.

* * * * *

UNITED STATES PATENT AND TRADEMARK OFFICE

CERTIFICATE OF CORRECTION

PATENT NO. : 4,451,033

DATED : May 29, 1984

INVENTOR(S) : Sander C. Nestegard

It is certified that error appears in the above-identified patent and that said Letters Patent is hereby corrected as shown below:

Col. 2, line 3, "pedals" should read - pedal --.

Col. 2, line 31, "pedals" should read - pedal --.

Col. 2, line 52, "peddles" should read -- pedals --.

Col. 2, line 53, "peddles" should read -- pedals --.

Col. 2, line 53, "peddles" (second occurrence) should read -- pedals --.

Col. 2, line 57, "peddles" should read -- pedals --.

Col. 2, line 59, "pedals" should read -- pedal --.

Col. 4, line 2, "pedals" should read -- pedal --.

Signed and Sealed this

*Twelfth* Day of *February 1985*

[SEAL]

*Attest:*

DONALD J. QUIGG

*Attesting Officer* *Acting Commissioner of Patents and Trademarks*